US007980500B2

(12) United States Patent
Jenni et al.

(10) Patent No.: US 7,980,500 B2
(45) Date of Patent: Jul. 19, 2011

(54) APPARATUS FOR CUTTING UP BIOLOGICAL SAMPLE MATERIAL

(75) Inventors: Stefan Jenni, Urdorf (CH); Daniel Krieg, Zurich (CH); Karsten Meissner, Urdorf (CH)

(73) Assignee: Prionics AG, Schlieren (CH)

( * ) Notice: Subject to any disclaimer, the term of this patent is extended or adjusted under 35 U.S.C. 154(b) by 492 days.

(21) Appl. No.: 12/066,979

(22) PCT Filed: Aug. 25, 2006

(86) PCT No.: PCT/EP2006/008329
§ 371 (c)(1),
(2), (4) Date: Apr. 30, 2008

(87) PCT Pub. No.: WO2007/033748
PCT Pub. Date: Mar. 29, 2007

(65) Prior Publication Data

US 2008/0208234 A1 Aug. 28, 2008

(30) Foreign Application Priority Data

Sep. 16, 2005 (EP) ..... 05020207

(51) Int. Cl.
*B02C 18/00* (2006.01)
*B02C 19/00* (2006.01)

(52) U.S. Cl. ..... 241/199.12; 241/282.2
(58) Field of Classification Search ..... 241/2, 169.1, 241/199.12, 282.1, 282.2
See application file for complete search history.

(56) References Cited

U.S. PATENT DOCUMENTS

| | | | | | |
|---|---|---|---|---|---|
| 2,764,359 | A | * | 9/1956 | Szegvari | 241/15 |
| 3,332,628 | A | * | 7/1967 | Wadham | 241/30 |
| 3,556,414 | A | * | 1/1971 | Eberly, Jr. | 241/1 |
| 3,601,322 | A | * | 8/1971 | Szegvari | 241/46.017 |
| 4,249,879 | A | | 2/1981 | Anders et al. | |
| 4,307,846 | A | * | 12/1981 | Spelsberg | 241/246 |
| 4,394,981 | A | * | 7/1983 | Schold | 241/46.17 |
| 4,505,433 | A | * | 3/1985 | Selenke | 241/46.01 |
| 4,561,156 | A | * | 12/1985 | Sun | 241/294 |
| 5,533,683 | A | * | 7/1996 | Fay et al. | 241/169 |
| 5,731,199 | A | * | 3/1998 | Roggero | 435/306.1 |
| 5,829,696 | A | | 11/1998 | DeStefano et al. | |
| 6,405,948 | B1 | * | 6/2002 | Hahn et al. | 241/1 |
| 6,517,561 | B1 | | 2/2003 | Phillips | |
| 7,370,819 | B2 | * | 5/2008 | Czarnek | 241/2 |
| 2004/0035964 | A1 | | 2/2004 | Roggero | |

FOREIGN PATENT DOCUMENTS

WO 02/48679 6/2002

* cited by examiner

*Primary Examiner* — Bena Miller
(74) *Attorney, Agent, or Firm* — Rankin, Hill & Clark LLP

(57) ABSTRACT

An apparatus for cutting up biological sample material, including a sample container, a rotary drive device separate from the sample container, and a shaft rotatably arranged in the sample container, wherein the shaft has a laterally projecting cutting device in the region of a working end and has a coupling piece in the region of a coupling end, said coupling piece being accessible from outside and being designed for coupling engagement with a coupling counterpart of the rotary drive device, wherein the shaft (14) is arranged with lateral guidance and in an axially displaceable manner in the sample container (10), the coupling piece (19) and the coupling counterpart (21) are designed for producing coupling engagement which is positive-locking in the direction of rotation (23) and permits an axial displacement, and the cutting device (16) is designed in a propeller shape in such a way that, during rotation of the shaft (14) in the working direction, it exerts a propulsive force on the latter in the direction of the coupling end (18).

4 Claims, 1 Drawing Sheet

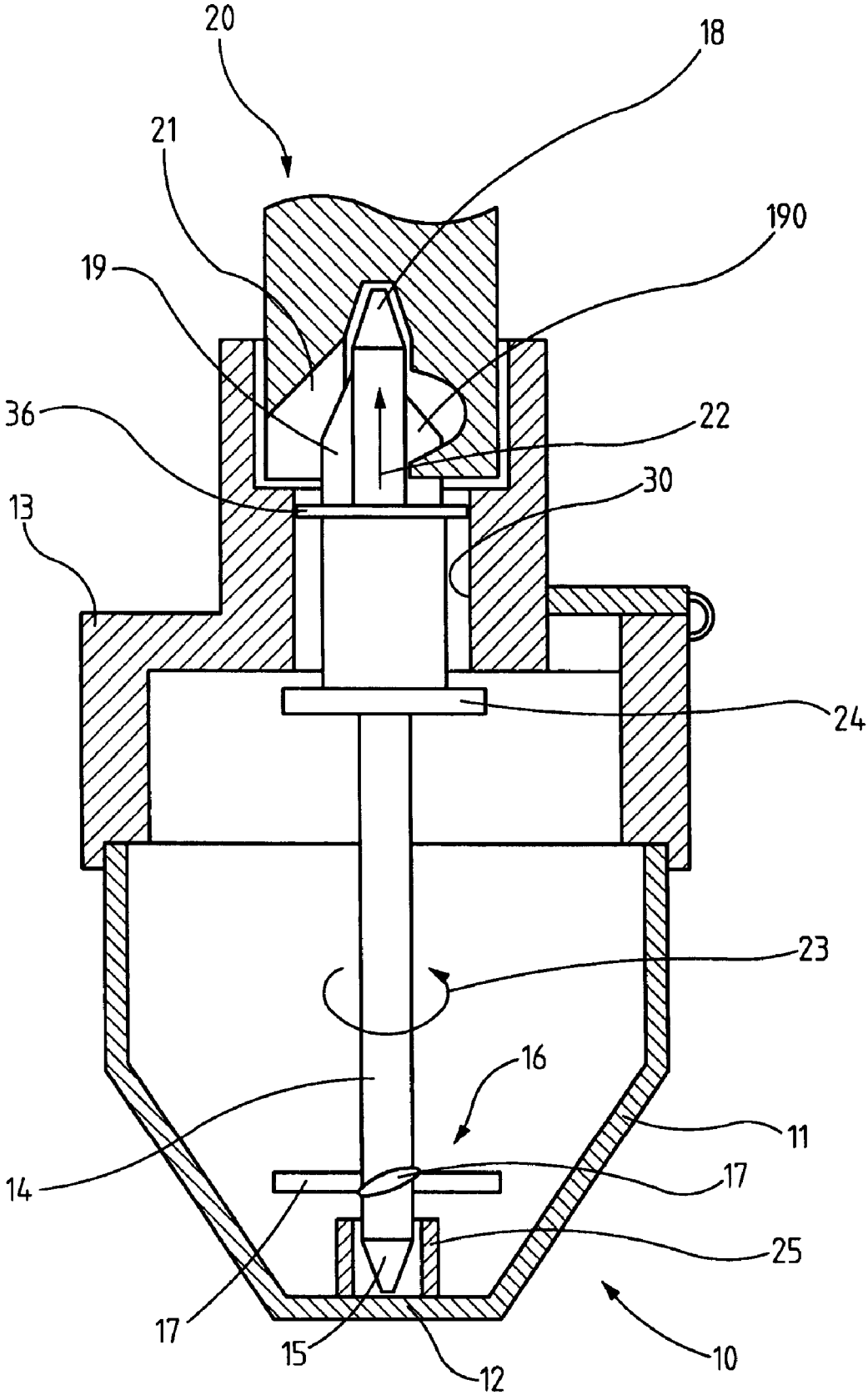
20
18
21
190
19
36
22
30
13
24
23
16
11
14
17
25
17
15
12
10

APPARATUS FOR CUTTING UP BIOLOGICAL SAMPLE MATERIAL

BACKGROUND OF THE INVENTION

The invention relates to an apparatus for cutting up biological sample material.

Apparatuses of the generic type are used in the examination of, in particular, solid biological sample material. This may be, for example, body tissue samples, but could also be other sample materials of biological origin having solid components.

As a rule, an examination presupposes that the sample material is present in homogenised form, for example in a buffer or the like. In the case of solid sample material, for example body tissue, the sample material must be cut up before the examination can occur.

An apparatus of the generic type which is used, in particular, for cutting up and homogenisation of cattle brain tissue in the context of BSE tests is known, for example, from WO02/48679.

The known apparatus has a sample container with a shaft disposed so as to be rotatable therein. The shaft is supported with one working end on the base of the sample container. A cutting device with a plurality of laterally projecting blades, which cut up sample material located in the sample container as the shaft rotates, is provided on the shaft in the region of its working end. At the other end of the shaft (coupling end), there is provided an externally accessible coupling member, which can be brought into coupling engagement with a complementary coupling member of a separate rotary drive device. The rotary drive device is designed in such a way that it can rotate the shaft at a relatively high speed (approximately 20,000 rpm).

In the known design, the coupling engagement is non-positive, in other words the rotary drive device or the complementary coupling member thereof presses from above onto the coupling end of the shaft. In order to minimize or to preclude the risk of any slippage, coupling must take place with a relatively high pressing force, with the consequence that the working end of the shaft likewise bears with a high pressure on the base of the sample container. In order to keep the friction which occurs here as low as possible, according to WO02/48679 a mounting is provided with a metal ball between the base and the working end of the shaft.

A disadvantage of the known apparatus is that in spite of the ball coupling, during operation an increased friction occurs in the region of the working end of the shaft, which can lead to difficulties.

BRIEF SUMMARY OF THE INVENTION

The object of the invention, starting from the prior art, is to create an apparatus in which the shaft can be rotated with the least possible friction.

This object is achieved by an apparatus including a sample container, a rotary drive device separate from the sample container and a shaft rotatably arranged in the sample container, wherein the shaft has a laterally projecting cutting device in the vicinity of one working end and has an externally accessible coupling member in the vicinity of a coupling end, which is constructed for coupling engagement with a complementary coupling member of the rotary drive device, wherein the shaft is arranged axially movably and with lateral guidance in the sample container, the coupling member and the complementary coupling member are constructed to produce a coupling engagement which is positive in the direction of rotation but permits axial movement and the cutting device is constructed in the shape of a propeller such that it exerts an advancing force in the direction of the coupling end on the shaft, when the shaft rotates in the working direction.

Like the known apparatus, the apparatus according to the invention has a sample container in which a shaft is disposed so as to be rotatable and axially movable. The shaft has a working end which can contact the base of the sample container in the state of rest of the shaft.

In the region of the working end a laterally projecting cutting device is provided which cuts the sample material up as the shaft rotates. The cutting device may comprise one or several blades which project laterally from the shaft. Furthermore, the blades can also be provided at different levels on the shaft.

The reference to the "region of the working end" should be interpreted relatively broadly. What is basically meant by this is that the cutting device is disposed in a region of the shaft which in conventional processes protrudes into the sample material.

The shaft also has a coupling end on which is provided a coupling member which can be brought into coupling engagement with the complementary member of a separate rotary drive device. Also the term "coupling member" or "complementary coupling member" should be interpreted broadly. It may relate to one or several surfaces and/or shapes which are constructed on the respective components and are tailored to one another.

According to the invention it is provided that the shaft is disposed so as to be guided laterally and axially movable in the sample container. In the simplest case only lateral guiding in the region of the coupling end of the shaft is provided. An axial displacement of the shaft in the direction towards its coupling end can be limited for example by a stop or the like constructed on the shaft. A movement of the shaft in the opposing direction is limited for example by the base of the sample container.

As a further feature of the invention it is provided that the coupling member and the complementary coupling member are constructed in order to produce a coupling engagement which is positive in the direction of rotation and in the axial direction allows a displacement of the shaft.

Finally, it is provided according to the invention that the cutting device disposed laterally on the shaft is constructed in the shape of a propeller in such a way that it exerts an advancing force on the shaft in the direction of the coupling end when the shaft rotates in the working direction.

The features provided in the apparatus according to the invention co-operate as follows:

After production of the coupling engagement with the rotary drive device, the shaft, and with it the cutting device, is rotated in the working direction and begins to cut up the sample material. At the same time, an advancing force builds up, which acts on the shaft and which as a function of the surrounding medium and starting from a specific speed of rotation displaces the shaft axially in the direction of the rotary drive device, which is possible because of the construction of the coupling member and the complementary coupling member according to the invention. In this case, the spacing of the working end of the shaft from the base of the sample container increases, with the consequence that the working end can rotate without contact with the base, that is to say without any friction.

The corresponding construction of the cutting device does not constitute a problem for the person skilled in the art. It is sufficient to provide the blade or blades of the cutting device with a corresponding inclination or leading edges in order to produce the necessary lift. This may involve a laterally projecting cutting device with a blade or a plurality of blades which project laterally at a level or also different levels from the shaft.

By a combination of a coupling engagement between the shaft and the rotary drive device, which enables an axial displacement of the shaft, as well as the advancing effect produced by the cutting device during rotation of the shaft, the occurrence of friction between the working end of the shaft and the base of the sample container is avoided in a simple and reliable manner.

Advantageous embodiments of the invention are set out in the claims.

As stated above, the shaft rotates without axial support of its working end on the base of the sample container. In the case of very solid sample material, in particular, this can lead to the shaft swinging out laterally in an undesirable manner upon contact of the cutting device with the sample material. In order to avoid this, a preferred embodiment provides that a socket for laterally guiding the working end of the shaft is provided on the base of the sample container.

In a further embodiment, it is provided that the coupling member provided on the coupling end of the shaft has one or several laterally projecting projections extending in the longitudinal direction. Particularly, preferably two projections are provided, which for example project on opposing sides of the shaft, their upper edges having different spacings from the coupling end. In this embodiment, twisting between the coupling member and the complementary coupling member can be avoided particularly reliably.

A further problem is that in operation fluid can rise in the sample container and can escape through the opening provided for the shaft. Sealing of the opening can be achieved in a particularly simple manner by construction of a peripheral projection disposed on the shaft. The projection is dimensioned and positioned on the shaft in such a way that it can it can rest on the opening during the axial displacement of the shaft in the direction of the coupling end, which occurs during operation. Thus, the projection also serves as a stop, which limits an axial displacement of the shaft.

BRIEF DESCRIPTION OF THE DRAWING

The invention is explained in greater detail below with reference to the accompanying drawing, which schematically shows a section view of an exemplary embodiment of an apparatus according to the invention.

DETAILED DESCRIPTION OF THE INVENTION

The drawing shows a sample container 10, which has a lower cup-shaped region 11 with a base 12, as well as an upper part 13 placed onto the cup-shaped part 11.

In the sample container 11, a shaft 14 is disposed so as to be rotatable and movable in the axial direction. The shaft has a working end 15. In the region of the working end 15, there is provided a cutting device 16, which in the illustrated case has a plurality of laterally projecting blades 17.

The other end of the shaft 14 is constructed as a coupling end 18 and has an externally accessible coupling member which is constructed in the form of two projections 19 and 190, which extend in the longitudinal direction and project laterally from the shaft 14. With its coupling end 18 the shaft 14 can be brought into engagement with a rotary drive arrangement 20, which is merely indicated and which has a corresponding complementary coupling member. The region of the complementary coupling member which comes into engagement with the projection 19 is denoted by 21 in the drawing.

The projections 19 and 190 extend by differing amounts in the direction of the coupling end 18 of the shaft 14, whereby twisting in the complementary coupling member is avoided.

As the drawing shows schematically, the coupling engagement, which can be produced between the coupling member 19 and the coupling member 21, is positive in the direction of rotation, and at the same time enables an axial movement of the shaft 14 in the direction of the coupling end 18, as indicated by the arrow 22. An axial movement of the shaft 14 in the direction of the arrow 22 occurs when the shaft 14 is rotated in the working direction indicated by the arrow 23. Due to the illustrated propeller-shaped arrangement of the blades 17, an advancing force is produced which acts on the shaft 14 in the direction of the arrow 22.

As a result the shaft 14 can undergo a displacement in which the working end 15 is distanced from the base 12 of the sample container 10. The displacement is limited by a projection 24 which is constructed to surround the shaft and serves as a stop and which in the stop position simultaneously seals off an opening 30 for the shaft 14 which is provided in the upper part 13 of the sample container 10. In the region of the opening 30 a projection 36 is constructed which surrounds the shaft 14 and by which the shaft 14 is guided laterally.

In order to ensure that no undesirable lateral swinging out of the working end 16 takes place during the rotation of the shaft 14, a socket 25 is also provided on the base 12 of the sample container 10, the said socket also ensuring lateral guiding of the shaft 14 in this region.

The invention claimed is:

1. An apparatus for cutting up biological sample material comprising a sample container, a rotary drive device separate from the sample container and a shaft rotatably arranged in the sample container, wherein the shaft has a laterally projecting cutting device in the vicinity of one working end and has an externally accessible coupling member in the vicinity of a coupling end, which is constructed for coupling engagement with a complementary coupling member of the rotary drive device, wherein the complementary coupling member is constructed in the form of at least one projection, which projects laterally from the shaft and extends in a longitudinal direction, wherein the shaft is arranged axially movably and with lateral guidance in the sample container, the coupling member and the complementary coupling member are constructed to produce a coupling engagement which is positive in the direction of rotation but permits axial movement and the cutting device is constructed in the shape of a propeller such that it exerts an advancing force in the direction of the coupling end on the shaft when the shaft rotates in the working direction.

2. The apparatus as claimed in claim 1, wherein a socket for laterally guiding the working end of the shaft is provided on the base of the sample container.

3. The apparatus as claimed in claim 1, wherein the complementary coupling member has two laterally projecting projections, the upper edges of which have different spacings from the coupling end.

4. The apparatus as claimed in claim 1, wherein there is provided on the shaft a peripheral projection, which is so dimensioned and arranged that, when the shaft is axially moved in the direction of the coupling end, it covers an opening provided for the shaft in the sample container.

* * * * *